United States Patent [19]

Schramm

[11] 3,983,812

[45] Oct. 5, 1976

[54] INKING SYSTEM ON PRINTING PRESSES HAVING PROVISION FOR VARYING INK DISTRIBUTION PERIPHERALLY ON PRINTING PLATE

[75] Inventor: Peter Schramm, Kahl am Main, Germany

[73] Assignee: Roland Offsetmaschinenfabrik Faber & Schleicher AG, Offenbach, Germany

[22] Filed: Sept. 10, 1975

[21] Appl. No.: 612,245

[30] Foreign Application Priority Data

Sept. 11, 1974 Germany ..... 2443504

[52] U.S. Cl. ..... 101/349; 101/DIG. 14

[51] Int. Cl.[2] ..... B41F 31/14; B41F 31/00

[58] Field of Search ..... 101/349, 350, 351, 352, 101/363, 364, 365, DIG. 14, 205–210; 118/7–9

[56] References Cited

UNITED STATES PATENTS

| | | | |
|---|---|---|---|
| 3,412,677 | 11/1968 | Kantor | 101/349 |
| 3,584,579 | 6/1971 | Rothenberg | 101/350 |
| 3,765,328 | 10/1973 | Treff | 101/349 |

*Primary Examiner*—J. Reed Fisher

*Attorney, Agent, or Firm*—Leydig, Volt, Osann, Mayer & Holt, Ltd.

[57] ABSTRACT

An inking system for a printing plate having a printing density which varies arbitrarily from the leading end of the plate to the trailing end including a source of ink film, rollers arranged in series between the source and the plate cylinder, the last roller in the series being a form roller in contact with the plate, with at least one of the rollers being a vibrated roller. Thrusting means are provided for imparting reciprocating movement to the vibrated roller. Means are provided for establishing a succession of sources of control signal at different levels tailored to the printing density of the plate at corresponding points about the periphery. A reference member coupled to the plate cylinder commutates the sources to produce a phased control signal which varies with ink need about the periphery of the plate. The control signal is utilized to vary the instantaneous velocity of the thrusting means inversely with the printing density of the plate so that ink is deposited on successive peripheral portions of the plate in a thickness tailored to need. In a preferred form of the invention a control board is used to set up the succession of sources of control signal visually corresponding to the profile of printing density, and hence ink need, at successive peripheral portions of the plate. The vibrated roller is preferably interposed between the source of ink and the form roller, but in a modified form of the invention the form roller itself is vibrated with variation in instantaneous velocity.

11 Claims, 7 Drawing Figures

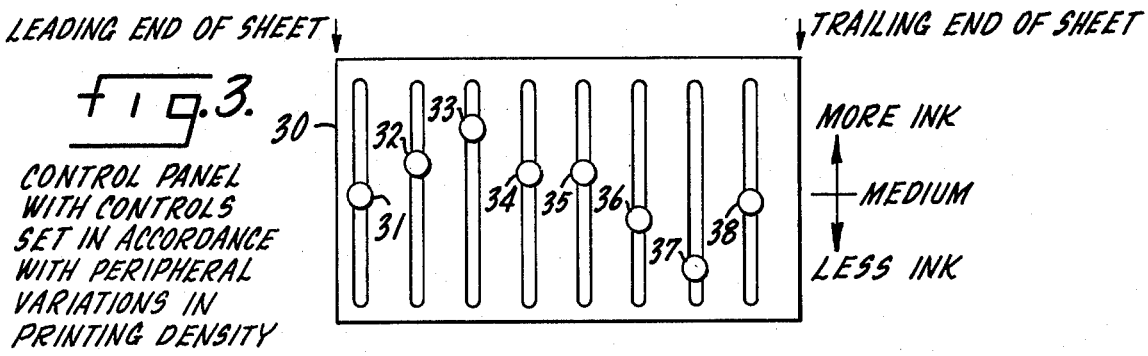
Fig. 3.
CONTROL PANEL WITH CONTROLS SET IN ACCORDANCE WITH PERIPHERAL VARIATIONS IN PRINTING DENSITY
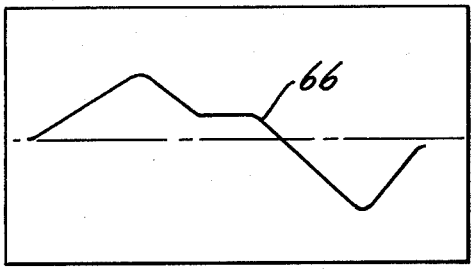
Fig. 4.
VARIATIONS IN CONTROL SIGNAL (PRINTING DENSITY)
Fig. 5.
INSTANTANEOUS VELOCITY OF AXIAL VIBRATOR MOVEMENT
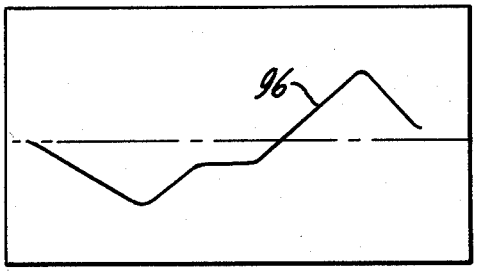
PLATE MOVEMENT
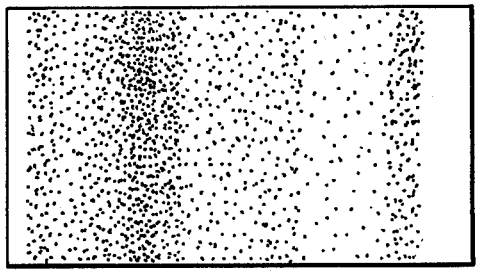
RESULTING VARIATION IN INK SUPPLIED TO PLATE
Fig. 6.

INKING SYSTEM ON PRINTING PRESSES HAVING PROVISION FOR VARYING INK DISTRIBUTION PERIPHERALLY ON PRINTING PLATE

BACKGROUND OF THE INVENTION

The need has been recognized in the past to furnish ink to a printing plate at a rate which varies along the axis of the printing cylinder, from one column position to the next, in accordance with the ink demand in the respective column positions.

Column-to-column variation in ink feed has been accomplished most commonly by providing a series of adjusting keys spaced along the length of the blade in the ink fountain, thereby producing longitudinal variation in the ink which is picked up from the fountain roller and which flows as merged ribbons of controlled thickness to the point where the ink is transferred from the form roller to the plate. Alternatively, in pressurized ink feed systems, ink is fed at different rates to wide nozzles arranged end-to-end in the longitudinal dimension.

However printing presses, both lithographic and of the letter press type, even of modern design, do not include means for varying the feeding of ink in accordance with need about the periphery, as contrasted with longitudinal dimension, of the plate cylinder. By way of an extreme example, there may be need to print a sheet, of which the top half has a high printing density, requiring heavy inking, while the bottom half contains no printing at all. Yet in a conventional printing press the feed rate in the inking system would be the same for all peripheral portions of the sheet, requiring the press operator to compromise between starvation of ink in the top half of the sheet and a flooding condition in the lower.

I have discovered that it is possible to vary the amount of ink fed at successive peripheral portions of a printing plate by varying the instantaneous velocity of a vibrated roller in the ink feed path, preferably a vibrated roller which is in ink-feeding relation to the form roller. More specifically I have found that the amount of ink transmitted by a vibrated roller tends to be inversely related to the instantaneous velocity of the vibrated roller. Thus, taking the example given immediately above of a sheet having a high printed density in the top half but not printed at all in the lower, the vibrated roller is caused to move with a relatively low axial velocity in creating the ink film which is utilized for printing of the top half of the sheet and moved at a relatively high axial velocity during times phased with passage of the lower portion of the sheet, thereby preventing buildup of non-utilized ink and creation of an incipient flooding condition.

In the past it has been common practice to maintain the form roller axially stationary and to utilize one or more vibrated rollers in the series of rollers which furnishes the ink film to the form roller for smooth merging of adjacent ribbons of ink having different thickness. However I have found that the present invention, namely, variation in ink flow inversely with instantaneous variation in axial velocity, may be achieved by vibration of the form roller itself, in a press of the lithographic type, without causing objectionable smearing of the ink between the printing and non-printing areas.

Not only does a conventional inking system fail to provide variation in ink flow in accordance with peripheral need, but conventional vibrating means, including cranks, swash plates or pneumatic drives, generally have a variation in velocity, for example, sinusoidal in the case of a crank or swash plate drive, such that the instantaneous velocity bears no relation to the peripheral variation in ink requirement and, indeed, in many cases the velocity variation may be directly contrary to the requirement of ink at localized areas.

To summarize, it is an object of the present invention to provide means for varying the flow of ink to a plate mounted on a printing cylinder so that the ink deposited in successive peripheral portions of the plate is in a thickness tailored to the need in each such portion.

It is a related object of the invention to provide means for varying the amount of ink supplied to a printing cylinder which is both simple and economical and which does not require any increase in the number of rollers in the ink feed path.

It is a further object of the present invention to provide means for controlling the instantaneous velocity of a vibrated roller in an ink feed path in accordance with peripheral variations in printing density of the particular plate being used. In this connection it is an object to provide a control board for establishing a succession of sources of control signal corresponding to printing density in which individual control elements are provided settable in vertial columns so that the setting thereof at levels tailored to variations in printing density provides a visual profile corresponding to the ink needs of the plate from the leading edge to the trailing edge.

Other objects and advantages of the invention will become apparent upon reading the attached detailed description and upon reference to the drawings in which:

FIG. 1 shows an ink feed system embodying the present invention with the elements shown diagrammatically for the purpose of easy understanding.

FIG. 1*a* diagrammatically shows a modified actuator reversing linkage which may be employed, if desired, in the practice of the invention.

FIG. 3 shows the front of a control panel with individual control elements settable in vertical columns and with the setting thereof being tailored to the peripheral variations in printing density to provide a visual profile of the ink needs of the plate from leading to trailing edge.

FIG. 4 shows the commutated control signal.

FIG. 5 is a plot of the resulting instantaneous velocity of axial vibrator movement; and FIG. 6 shows the resulting variation in ink supplied to the plate.

Figures 1, 1A, 2:
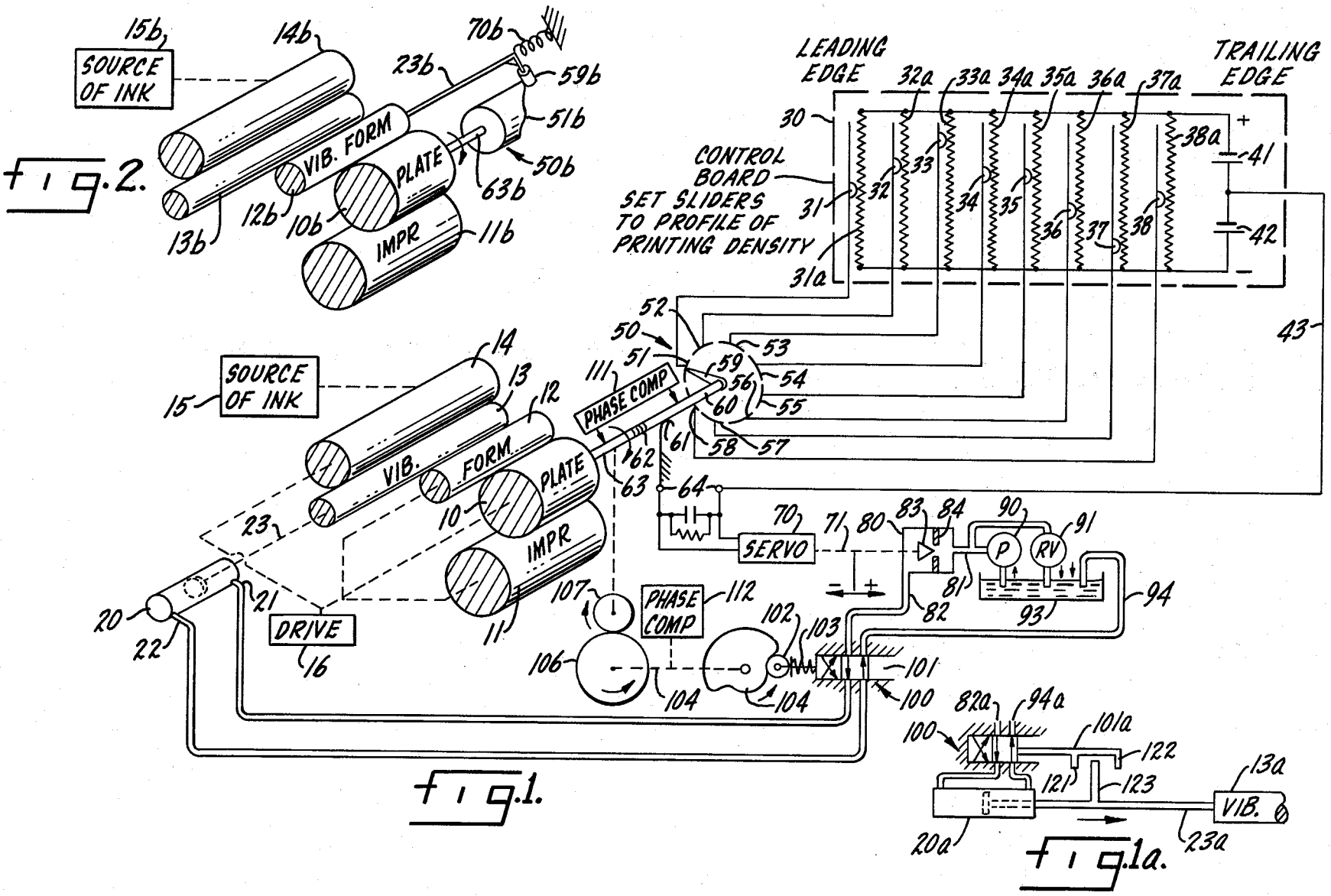
FIG. 2 shows a modified form of the invention in which the form roller is used as the vibrated element and in which the desired variation in instantaneous velocity is attained by purely mechanical means.

While the invention has been described in connection with preferred and alternate embodiments, it will be understood that the invention is not limited to the particular illustrated embodiments and that I intend, on the contrary, to cover all of the various alternative and equivalent forms of the invention included within the spirit and scope of the appended claims.

Turning now to FIG. 1 a plate cylinder 10 cooperates with an impression cylinder 11, the plate cylinder having a "once around" printing plate (not shown) secured to its periphery. In rolling contact with the plate on the plate cylinder is a resilient form roller 12 which receives ink from a vibrated roller 13 fed by an ink drum 14 from a source of ink generally indicated at 15, and which may consist of a conventional ink fountain and series of feeding and smoothing rollers. The rollers are driven in unison by a press drive indicated at 16.

For the purpose of vibrating the roller 13, a thrusting device in the form of a reciprocating hydraulic actuator 20 is used having end connections 21, 22 and with the piston thereof thrustingly connected to the vibrated roller 13 by means of a suitable mechanical connection 23.

In accordance with the present invention means are provided for supplying hydraulic fluid to the actuator 20 at a variable rate which varies inversely with respect to the ink requirement of successive peripheral portions of printing plate. More specifically means are provided for establishing a succession of sources of control signal at different levels tailored to the printing density of the plate at corresponding points about the periphery, and means are provided for commutating the sources, phased with respect to the angular position of the plate cylinder, to produce a control signal for varying the rate of fluid flow.

Thus I provide a control board 30 having control knobs 31–38 in the form of sliders on potentiometer resistance elements **31*a*–38*a* which are connected across a voltage source. The voltage source preferably consists of batteries or equivalent 41, 42 having a neutral line 43**, so that when the sliders are all set at mid position, zero voltage exists, as a reference, on each of the slider terminals.

For the purpose of commutating the individual sources of control signal 31–38 to produce a control signal which varies in accordance with ink need, a commutator 50 is provided having segmentary electrical contacts 51–58, respectively, which are swept by a wiper 59. The wiper has a shaft 60 contacted by a brush 61, the shaft having an insulated connection 62 to a drive shaft 63 which is connected either to the plate cylinder or to the impression cylinder. The resulting commutated output signal thus appears across terminal 64, with a suitable RC circuit 65 being used as a filter causing the commutated signal to be smoothed or faired. The control signal 66 resulting from the setting shown in FIGS. 1 and 3 is set forth, by way of example, in FIG. 4.

In order to produce variations in the rate of fluid flow in accordance with the control signal, an electromechanical servo device 70 is used having a mechanical output element 71 which is positioned endwise from a neutral position in accordance with the magnitude and polarity of the control signal, as indicated. The output element of the servo device is connected to a throttle valve 80 having an inlet 81 and an outlet 82. More specifically, the mechanical output element of the servo is connected to the plunger 83 of the throttle valve which cooperates with a seat 84. For furnishing fluid to the throttle valve at a reference pressure, a pump 90, which is preferably of the positive displacement type, is provided having a calibrated relief valve 91, the pump receiving fluid from, and the relief valve discharging fluid into, a fluid sump 93 fed by a return line 94. The effect is to produce variations in rate of flow through the line 82, both above and below a reference level, in accordance with variations, from reference level, in the control signal. The rate of fluid flow and the instantaneous velocity of the actuator piston resulting from the control signal of FIG. 4 are both indicated in FIG. 5.

In carrying out the present invention means are not only provided for varying the instantaneous rate of fluid flow to the actuator but also for reciprocating the direction of thrust of the actuator on a cyclical basis which is preferably synchronized with the revolutions of the plate cylinder. Such cyclical reversal is accomplished by a four-way or reversing type valve 100 with "inlet" connections made to lines 82–94 and with "outlet" connections made to the respective actuator lines 21, 22. The reversing valve 100 may have a conventional plunger 101 with reversing ports driven by a cam follower 102 biased by a return spring 103. The cam follower cooperates with a cam 104 having 180° forward and reverse sectors and which is connected via a connection 105 to a pair of gears 106, 107 having a 2:1 stepdown speed ratio and which are driven via a connection 108 phased with respect to the plate cylinder.

If the form roller 12 were the axially vibrated element, the wiper 59 of the commutator could be simply synchronized with the region of contact between the form roller and plate cylinder, approximately as shown, and the cam 104 which controls the reversing valve 100 could similarly be synchronized to produce shifting at moments coinciding with the passage of the gap between the leading and trailing ends of the plate. However, in the embodiment of FIG. 1 there is a delay between the time of occurrence of an event at the vibrated roller 13 and the time that the effect occurs at the surface of a plate on plate cylinder 10, because of the interval during which the film, modified by the vibrated roller is on the form roller. For example if the length of the film path on the form roller is 20 percent of the length of the plate periphery, then the profile of the velocity signal must be advanced by advancing the wiper of the commutator by the same percentage. Such phase advancement of the control signal may be conveniently brought about by inserting a phase compensation device 111 between the commutator shaft 60 and the plate cylinder shaft 63. Under such circumstances the cam 104 should be advanced by the same percentage using a phase compensating device 112 between the cam and the gear which drives it. The compensation at 112 may be most simply brought about by shifting the angular position of the cam 104 upon the shaft 105 which drives it.

While the operation of the device will be apparent from the foregoing description, it may be summarized briefly as follows: The knobs 31–38 (FIGS. 1 and 3) are set up in a visual profile which corresponds to printing density, that is, the ink demand at peripherally spaced positions between the leading and trailing edges of the sheet or plate. Upon successive connection, or commutation, of the individual control settings by the commutator 50, a control signal 66 is produced (FIG. 4) smoothly faired by the RC or filter circuit 65. By action of the electromechanical servo device 70, variation of the control signal above and below a neutral value is translated into the position of servo output element 71 to the right or left of a neutral position to control a throttle valve 80 to produce corresponding variations in rate of fluid flow through line 82. Because of the polarity of movement of the servo output element, the rate of fluid flow is the inverse of the control signal established on the control board, which is desired since maximum ink density corresponds to minimum axial velocity at the vibrated element. In other words, the instantaneous velocity curve 96 (FIG. 5) is the inverse of the control signal and printing density curve 66

(FIG. 4). The result is to produce a variation in the amount of ink deposited upon the plate on the plate cylinder in approximately in proportion to the printing density of the plate, indicated by the shading in FIG. 6.

In order to periodically reverse the direction of movement of the actuator, the reversing valve 100 causes direction of reversal of fluid flow, with the actuating cam for the valve being preferably so phased that the effect of the reversal falls within the gap between the ends of the plate on the plate cylinder. It is not, however, essential that the reversal of vibration coincide with the gap and, if desired, a self-reversing linkage may be employed as set forth in FIG. 1*a* in which corresponding parts are indicated by corresponding reference numerals with addition of subscript *a*. In this case the valve plunger 101*a* is provided with spaced abutments 121, 122 which are alternately engaged by a dog 123 carried by the actuator plunger 23*a*.

The above electro-mechanical control system has been purposely greatly simplified in order to facilitate understanding, and it will be appreciated by one skilled in the art that state of the art techniques, including solid state amplification in the servo, may be utilized to refine the operation without departing from the spirit and scope of the invention.

Moreover, while it is preferred to generate a succession of electrical signals and to commutate such signals to produce a control signal varying in accordance with printing density, which control signal is subsequently utilized in a servo device to control the rate of actuator movement, the invention, in its broader aspects, is not limited thereto and the invention may be practiced employing purely mechanical means as set forth in FIG. 2 in which corresponding parts are indicated by corresponding reference numerals with addition of subscript *b*. In this figure the "control signal" originates in a cam 50*b* coupled to the plate cylinder and having an axially presented cam surface 51*b* which is engaged by a cam follower 59*b* having an associated return spring 70*b* and having a connection 23*b* to the form roller. In such embodiment, the vibrated roller, which also serves the function of the form roller, 12*b*, is moved endwise in accordance with a cyclical program or profile by the effect of the cam 50*b* upon cam follower 59*b*, with the cam being connected to the plate cylinder for rotation and synchronism. The "control signal" in the embodiment of FIG. 2 is the instantaneous slope of the cam surface 51*b* with respect to a transaxial plane. In regions where such slope is high, the velocity of the vibrated form roller 12*b* is great and the amount of ink fed, conversely, is at a minimum. On the other hand where the slope of the cam surface is shallow, the instantaneous velocity of the roller 12*b* is slow resulting in feeding of maximum ink to the plate. The slope in successive regions is inversely tailored to ink need at corresponding regions on the plate.

It will be understood, however, that the embodiment illustrated in FIG. 2 is not as practical as that set forth in FIG. 1 since each sheet to be printed will require the construction of a cam 50*b* having a distinctively profiled surface 51*b*, and consequently the modification shown in FIG. 2 is intended primarily to illustrate the scope of the present invention.

While the invention, in its preferred embodiment, has been discussed in connection with a "one around" plate on the plate cylinder, the invention is not limited thereto and may obviously be extended to a larger, "two around" plate cylinder without sacrifice of the fineness of control simply by doubling the number of sliders and commutated segments. In a practical construction parameters may be established to bring about a range of axial speed from 0 feet per second, for maximum inking, to 8 feet per second for minimum inking.

It will be apparent that instead of using sliders for adjustment, a two-dimensional plug board may be used having a plug in each column which may be selectively inserted in a vertical row of openings to make the equivalent electrical contact with the resistance element. Also it will be understood that while the term "vertical" has been used in describing the control columns, this is a relative term and the columns may be oriented at any desired angle from that shown without departing from the invention.

Also while a servo controlled throttle valve has been illustrated as one mode of practicing the invention, it will be apparent that a servo, responsive to a control signal, may be used in other ways equally convenient; for example, the servo 70 may be used to control the speed of an electric motor driving a positive displacement type hydraulic pump for driving the actuator. Indeed, the servo, in such event, may be replaced if desired by a solid state amplifier having electrical output or, if desired, an electric motor, operated at a speed varying inversely with the control signal, may be directly employed to reciprocate the connection 23 by a suitable mechanical linkage without departing from the invention.

While the vibrated roller is shown in FIG. 1 interposed in the direct ink feed path from the source 15, it is not necessary for the vibrated roller to be directly in series therewith. Since the vibrated roller serves as a rotating ink storage element, it may be "effectively" interposed between the source and the form roller for feeding to the latter even though it may be off to one side of a direct path from the source to the form roller.

The invention as described has not been limited to presses of either the lithographic or letter press type, and it will be apparent to one skilled in the art that in the case of a lithographic press the impression cylinder 11 will be replaced by a resilient blanket cylinder pressing, in turn, against the usual impression cylinder.

I claim as my invention:

1. In an inking system for a printing press, the combination comprising a plate cylinder mounting a printing plate thereon having a printing density which varies arbitrarily from the leading end of the plate to the trailing end, a form roller in rolling contact with the plate, a source of ink film for the form roller, a vibrated roller on the form roller and effectively interposed between the ink source and the form roller, the vibrated roller having thrusting means for imparting reciprocating movement thereto, means for establishing a succession of sources of control signal at different levels tailored to the printing density of the plate at corresponding points about the periphery thereof, a reference member movable in phase with the plate, means coupled to the reference member for commutating the sources to produce a varying control signal which varies with ink need about the periphery of the plate, and means for varying the instantaneous velocity of the thrusting means in accordance with the varying control signal so that ink is deposited on the plate in a thickness tailored to need.

2. The combination as claimed in claim 1 in which the thrusting means is in the form of an hydraulic actuator coupled to a source of pressurized fluid and in which the means for instantaneously varying the velocity is in the form of a valve interposed between the actuator and the source, the valve having servo means for opening and closing the same in accordance with the varying control signal.

3. The combination as claimed in claim 2 in which a reversing valve is interposed ahead of the actuator with means for periodically operating the reversing valve near the ends of the stroke of the actuator for achieving reciprocating movement of the actuator.

4. The combination as claimed in claim 1 in which the means for establishing a succession of sources of control signal at different levels is in the form of a control board having individual control elements settable in vertical columns so that the setting thereof at levels tailored to the printing density provides a visual profile of the ink needs of the plate from the leading edge to the trailing edge.

5. The combination as claimed in claim 1 in which there is a gap at the end of the plate and in which the thrusting means is in the form of a hydraulic actuator having means including a reversing valve for reversing the direction of application of pressure to the actuator, the reversing valve being synchronized with the plate cylinder so that reversal of the vibrating roller effectively occurs at a position corresponding to the gap at the end of the plate.

6. In an inking system for a printing press, the combination comprising a plate cylinder mounting a printing plate thereon having a printing density which varies arbitrarily from the leading end of the plate to the trailing end, a form roller in rolling contact with the plate, a source of ink film for the form roller, a vibrated roller on the form roller and effectively interposed between the source and the form roller, a reversible hydraulic actuator coupled to the vibrated roller, a source of pressurized fluid and means for periodically applying the pressurized fluid to the alternate ends of the actuator for reciprocating the vibrated roller over a range of axial movement, means for establishing a succession of sources of control signal at different levels tailored to the printing density of the plate at corresponding points about the periphery thereof, a reference member movable in phase with the plate cylinder, means coupled to the reference member for commutating the sources to produce a varying control signal having a profile which varies in accordance with the ink needed to satisfy the variations in printing density about the periphery of the plate, means interposed between the source of pressure fluid and the actuator for varying the rate of flow of the fluid in accordance with variations in the control signal so that the vibrated roller is moved axially at an instantaneous velocity which varies inversely with the ink need at successive peripheral portions of the plate.

7. In an inking system for a printing press, the combination comprising a plate cylinder mounting a printing plate thereon having a printing density which varies arbitrarily from the leading end of the plate to the trailing end, a form roller in rolling contact with the plate, a source of ink film for the form roller, a vibrated roller on the form roller and effectively interposed between the source and the form roller, the vibrated roller having thrusting means for imparting reciprocating movement thereto, means for creating a varying control signal having a profile which varies in accordance with the ink needed to satisfy the variations in printing density from the leading end of the plate to the trailing end, means for phasing the varying control signal with respect to the plate cylinder, and means for varying the instantaneous velocity of the thrusting means in accordance with the varying control signal so that the ink which is deposited by the form roller on the plate is more nearly in proportion to the peripheral variation in printing density of the plate, the phasing means advancing the phase of the control signal with respect to the phase of the plate cylinder to compensate for the length of film on the form roller.

8. In an inking system for a printing press, the combination comprising a plate cylinder mounting a printing plate thereon having a printing density which varies arbitrarily from the leading end of the plate to the trailing end, a source of ink film for the plate cylinder, a vibrated roller effectively interposed between the source and the plate cylinder, the vibrated roller having thrusting means for imparting axial movement thereto, means for creating a varying control signal having a profile which varies in accordance with the ink needed to satisfy the variations in printing density at successive peripheral regions of the plate from the leading end of the plate to the trailing end, means for phasing the control signal with respect to the rotation of plate cylinder, and means responsive to the control signal for varying the instantaneous axial velocity of the thrusting means in accordance with variations in the control signal so that the instantaneous axial velocity of the vibrated roller is inversely related to the ink need at the corresponding peripheral regions of the plate, and means for periodically reversing the direction of movement of the thrusting means.

9. In an inking system for a printing press, the combination comprising a plate cylinder mounting a printing plate thereon having a printing density which varies arbitrarily from the leading end of the plate to the trailing end, a source of ink film, rollers arranged in series between the source and the plate cylinder with the last roller in the series being a form roller in contact with the plate, at least one of the rollers being a vibrated roller, the vibrated roller having thrusting means for imparting reciprocating movement thereto, means for establishing a succession of sources of control signal at different levels tailored to the printing density of the plate at corresponding points about the periphery thereof, a reference member movable in phase with the plate, means coupled to the reference member for commutating the sources to produce a varying control signal which varies with ink need about the periphery of the plate, and means for varying the instantaneous velocity of the thrusting means in accordance with the varying control signal so that ink is deposited on successive peripheral portions of the plate in a thickness tailored to need.

10. The combination as claimed in claim 9 in which the vibrated roller is the form roller.

11. In an inking system for a printing press, the combination comprising a plate cylinder mounting a printing plate thereon having a printing density which varies arbitrarily from the leading end of the plate to the trailing end, a source of ink film, rollers arranged in series between the source and the plate cylinder with the last roller in the series being a form roller in contact with the plate, at least one of the rollers being a vibrated roller, the vibrated roller having thrusting means for imparting reciprocating movement thereto, means for creating a varying control signal having a profile which varies in accordance with the ink needed to satisfy the variations in printing density at successive peripheral regions of the plate from the leading end of the plate to the trailing end, means for phasing the varying control signal with respect to the rotation of plate cylinder, and means responsive to the varying control for varying the instantaneous axial velocity of the thrusting means in accordance with variations in the control signal so that the instantaneous axial velocity of the vibrated roller is inversely related to the ink need at the corresponding peripheral regions of the plate.

* * * * *